US010657929B2

(12) United States Patent
Sumitani

(10) Patent No.: US 10,657,929 B2
(45) Date of Patent: May 19, 2020

(54) IMAGE DISPLAY SYSTEM WITH IMAGE ROTATION PROCESSING

(71) Applicant: SHARP KABUSHIKI KAISHA, Sakai, Osaka (JP)

(72) Inventor: Ken Sumitani, Sakai (JP)

(73) Assignee: SHARP KABUSHIKI KAISHA, Sakai, Osaka (JP)

( * ) Notice: Subject to any disclaimer, the term of this patent is extended or adjusted under 35 U.S.C. 154(b) by 0 days.

(21) Appl. No.: 16/158,086

(22) Filed: Oct. 11, 2018

(65) Prior Publication Data

US 2019/0114998 A1 Apr. 18, 2019

(30) Foreign Application Priority Data

Oct. 12, 2017 (JP) ..... 2017-198606

(51) Int. Cl.
*G09G 5/397* (2006.01)
*G09G 5/00* (2006.01)

(52) U.S. Cl.
CPC ..... *G09G 5/397* (2013.01); *G09G 5/005* (2013.01); *G09G 2340/0492* (2013.01); *G09G 2360/18* (2013.01)

(58) Field of Classification Search
None
See application file for complete search history.

(56) References Cited

U.S. PATENT DOCUMENTS 6,809,737 B1 * 10/2004 Lee ..... G06T 3/606 345/503
7,535,474 B1 * 5/2009 Scholander ..... G09G 5/39 345/531
2003/0095124 A1 * 5/2003 Tjandrasuwita ..... G09G 5/395 345/538
2004/0012724 A1 * 1/2004 Jang ..... G09G 3/20 348/739
2004/0150581 A1 * 8/2004 Westerinen ..... G06F 1/1601 345/1.3
2005/0248580 A1 11/2005 Osako
2011/0037773 A1 * 2/2011 Ishioka ..... G09G 5/001 345/545
2014/0152695 A1 * 6/2014 Ishiwata ..... G09G 5/14 345/629
2014/0358981 A1 * 12/2014 Miyake ..... H04L 67/1095 709/201

FOREIGN PATENT DOCUMENTS

CN 101625751 A 1/2010
CN 104219276 A 12/2014
JP 2009-265547 A 11/2009
JP 2015-109592 A 6/2015

* cited by examiner

*Primary Examiner* — Kee M Tung
*Assistant Examiner* — Patrick F Valdez
(74) *Attorney, Agent, or Firm* — ScienBiziP, P.C.

(57) ABSTRACT

An image receiving device includes an image processing unit that rotates at least one of first and second images in a process of restoring the first and second images if an image transfer signal received by the image receiving device includes the first and second images in which a direction in which a scan line of the first image extends is different from a direction in which a scan line of the second image extends.

9 Claims, 4 Drawing Sheets

IMAGE DISPLAY SYSTEM WITH IMAGE ROTATION PROCESSING

BACKGROUND

1. Field

The present disclosure relates to an image display system.

2. Description of the Related Art

Traditionally, display devices that combine multiple input images into an image and display the combined image are known. Such display devices use a line buffer and a frame buffer to combine images into an image and display the combined image (refer to, for example, Japanese Unexamined Patent Application Publication No. 2015-109592).

In addition, display apparatuses, each of which transfers an image from an image transferring device to multiple display devices and causes the multiple display devices to display the image, are known. In each of such display apparatuses, the image transferring device causes image data read from a storage unit to be temporarily stored in a frame buffer and transfers the image data to the display devices (refer to, for example, Japanese Unexamined Patent Application Publication No. 2009-265547).

In the case where at least two images, in which vertical and horizontal directions of one of the images with respect to a direction in which scan lines of the one of the images extend are different from vertical and horizontal directions of the other of the images with respect to a direction in which scan lines of the other of the images extend, are transferred from an image transferring device to a display device and displayed by the display device, the image transferring device uses a frame buffer to buffer at least one of the images and transfers the image in general. However, the frame buffer uses a larger memory capacity than a line buffer, resulting in an increase in the cost of the image transferring device, an increase in power consumption, and the occurrence of a delay in image transfer.

SUMMARY

The techniques disclosed herein have been developed under the aforementioned circumstances to realize an image display system that efficiently transfers multiple images in which vertical and horizontal directions of one of the images with respect to a direction in which scan lines of the one of the images extend are different from vertical and horizontal directions of the other of the images with respect to a direction in which scan lines of the other of the images extend, and displays the multiple images.

To solve the aforementioned problems, an image display system according to an aspect of the disclosure includes an image generating device that generates and outputs multiple images, an image transferring device that converts the multiple images to an image transfer signal and outputs the image transfer signal, an image receiving device that receives the image transfer signal and restores the multiple images, and an image display unit that displays the multiple images. The image receiving device includes an image processing unit that rotates at least one of a first image and a second image in a process of restoring the first image and the second image if the received image transfer signal includes the first and second images in which a direction in which a scan line of the first image extends is different from a direction in which a scan line of the second image extends.

DESCRIPTION OF THE EMBODIMENTS

First Embodiment

Figure 1:
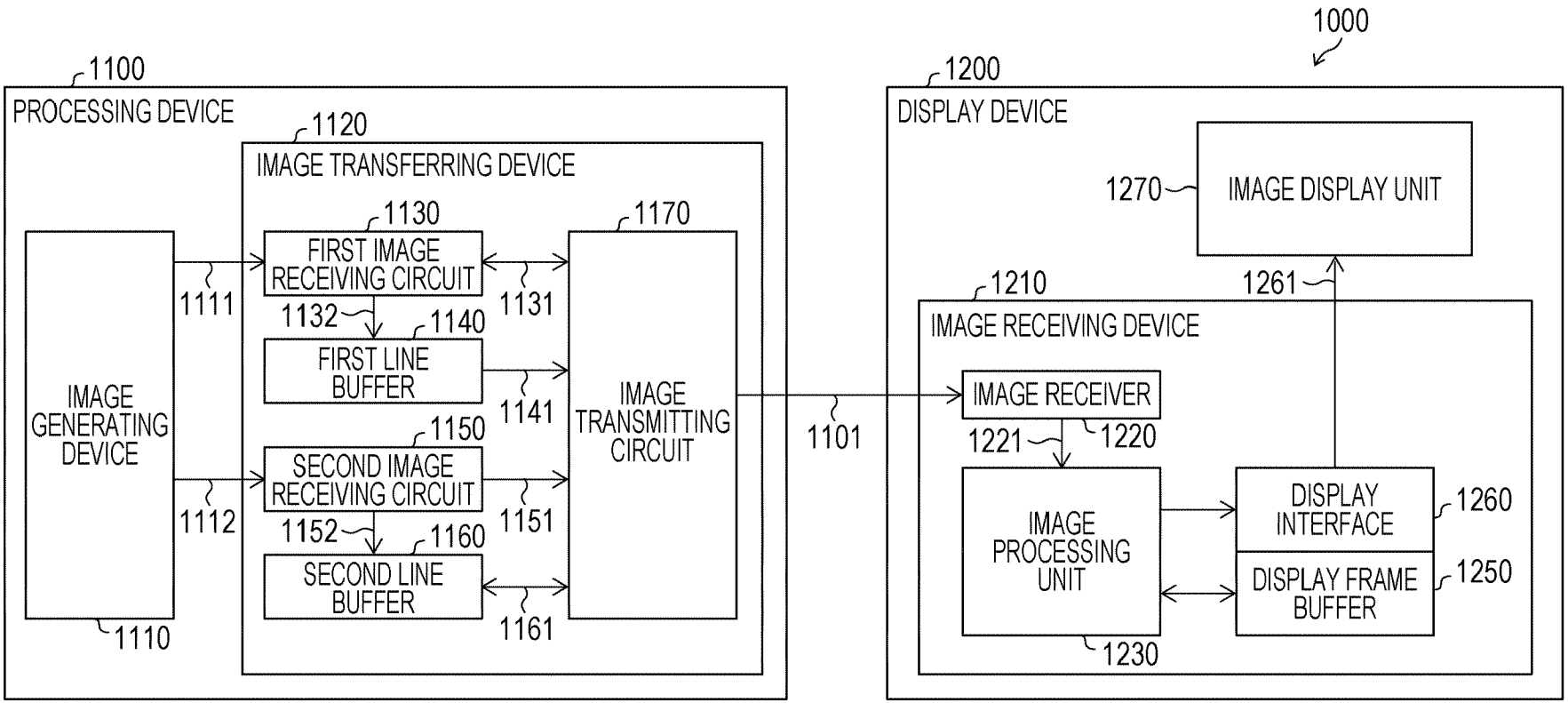
FIG. 1 is a block diagram showing a main configuration of an image display system according to a first embodiment.

An image display system 1000 according to a first embodiment is described in detail with reference to FIG. 1. FIG. 1 is a block diagram showing a main configuration of the image display system 1000.

Configuration of Image Display System 1000

As shown in FIG. 1, the image display system 1000 includes a processing device 1100 and a display device 1200.

The processing device 1100 is an electronic device having a function of generating images and outputting the generated images.

The display device 1200 is an electronic device with a display for displaying the received images. The display may be a liquid crystal display or organic electroluminescent display for a television, a smartphone, a tablet, a mobile game machine, or the like.

Overview of Base Technique

In the case where multiple images are to be transferred from an image transferring device to a display device and displayed by the display device, and vertical and horizontal directions of one of the images with respect to a direction in which scan lines of the one of the images extend are different from vertical and horizontal directions of the other of the images with respect to a direction in which scan lines of the other of the images extend, not only a line buffer but also a frame buffer are used to transfer and display the multiple images.

The frame buffer uses a larger memory capacity than the line buffer. For example, for VGA resolution (640 dots×480 dots) of 16-bit colors, a memory capacity of 600 kilobytes is used for each frame in the frame buffer. In addition, for HD resolution (1920 dots×1080 dots) of 24-bit colors, a memory capacity of approximately 6 megabytes is used for each frame in the frame buffer.

For VGA resolution of 16-bit colors, a memory capacity of 1280 bytes is used for each line in the line buffer. For HD resolution of 24-bit colors, a memory capacity of 5760 bytes is used for each line in the line buffer. Thus, the memory capacities to be used in the frame buffer are significantly different from the memory capacities to be used in the line buffer.

In addition, during the transfer of image data, the buffers continuously receive the next image data. Thus, a buffer for two frames or two lines is used in many cases.

For double buffering for inhibiting flicker in a display and for output control of the display, the display device includes a sufficient resource such as a memory in many cases, and a DRAM is externally connected to an SoC in general. As described above, since the display device includes a relatively large-capacity memory as a standard in many cases, a large-capacity memory may be easily prepared for a frame buffer in the DRAM.

To prepare a large-capacity memory for a frame buffer in an image transferring device, a configuration in which an LSI for control and an external RAM are installed is prepared or a large-scale memory is installed in an LSI for control. This, however, results in a significant increase in the cost of the image transferring device and an increase in power consumption. In addition, if the frame buffer is used to transfer an image, the image transfer is started after image data for a single frame is stored in the frame buffer, for example. Thus, the delay from the time when images are generated to the time when the images are finally displayed is longer, compared with the case where a line buffer is used.

On the other hand, if an image is transferred using a line buffer without using a frame buffer, the transfer may be enabled by preparing an SRAM in a control LSI of the image transferring device.

The first embodiment describes in detail a technique for using line buffers to transfer images from an image transferring device to a display device without using a frame buffer.

Configuration of Processing Device 1100

The processing device 1100 includes an image generating device 1110 and an image transferring device 1120.

Although not shown in FIG. 1, the image generating device 1110 includes a CPU and an LSI such as an SoC and generates and outputs images. The image generating device 1110 generates at least two images including different details, outputs a first image A as a first display control signal 1111, and outputs a second image B as a second display control signal 1112. Vertical and horizontal directions of the first image A with respect to a direction in which scan lines of the first image A extend may be different from vertical and horizontal directions of the second image B with respect to a direction in which scan lines of the second image B extend.

The image transferring device 1120 acquires the first and second display control signals 1111 and 1112 generated by the image generating device 1110. The image transferring device 1120 converts the acquired first and second display control signals 1111 and 1112 to an image transfer signal 1101 and outputs the image transfer signal 1101 to an external of the processing device 1100.

The image transferring device 1120 includes a first image receiving circuit 1130, a second image receiving circuit 1150, a first line buffer 1140, a second line buffer 1160, and an image transmitting circuit 1170.

When the image transferring device 1120 receives the first and second display control signals 1111 and 1112, the image transferring device 1120 stores (or buffers) at least a portion of image data of each of the first and second images A and B in the first line buffer 1140 and the second line buffer 1160 to transfer the first image A and the second image B via the image transmitting circuit 1170.

As a method of storing the image data of each of the first and second images A and B in the first and second line buffers 1140 and 1160, multiple rows may be stored as a collection of data or a single row may be divided into multiple data portions and the multiple data portions are stored. The case where a single row is stored as a collection of data as a unit of processing is described below.

The first image receiving circuit 1130 and the second image receiving circuit 1150 reference horizontal retrace signals HSYNC issued in retrace time periods after the completion of drawing in a horizontal direction in which scan lines extend. Then, the first image receiving circuit 1130 and the second image receiving circuit 1150 detect delimiters of line drawing on a screen, and transmit image data for one row between horizontal retrace signals HSYNC to each of the first line buffer 1140 and the second line buffer 1160. The image data may be transmitted via multiple signal lines in parallel to each of the first line buffer 1140 and the second line buffer 1160 based on the rate of transmitting the image data and the amount of the image data.

Each of the first and second line buffers 1140 and 1160 may include a memory for storing multiple rows. In this case, in each of the first and second line buffers 1140 and 1160, for example, when data of the top row is received, the received data of the top row is written to a first line buffer. Then, when data of the second row is received, the received data of the second row is not written to the first line buffer, details of the written data of the top row are held in the first line buffer, and the received data of the second row is written to a second line buffer. During the writing of the data of the second row to the second line buffer, the data written to the first line buffer is transmitted by the transmitting circuit 1170. When data of the third row is received, the data of the third row is written to the first line buffer from which the details of the data of the top row have already been transmitted. During the writing of the data of the third row to the first line buffer, the data of the second row that has been written to the second line buffer is transmitted by the transmitting circuit 1170. In this manner, since the two line buffers are alternately used, image data may be uninterruptedly transmitted.

The first image receiving circuit 1130 references horizontal retrace signals HSYNC included in the first display control signal 1111 output by the image generating device 1110 and acquires the first display control signal 1111 for each of lines. In addition, the first image receiving circuit 1130 uses a transfer control signal 1131 to communicate with the image transmitting circuit 1170 and processes the acquired first display control signal 1111 for each of the lines along the scan lines of the first image A. The first image receiving circuit 1130 uses a first buffer control signal 1132 to transmit at least a portion of image data based on the first display control signal 1111 to the first line buffer 1140.

The second image receiving circuit 1150 references horizontal retrace signals HSYNC included in the second display control signal 1112 output by the image generating device 1110 and acquires the second display control signal 1112 for each of lines. In addition, the second image receiving circuit 1150 uses a transfer control signal 1151 to communicate with the image transmitting circuit 1170 and processes the acquired display control signal 1112 for each of the lines along the scan lines of the second image B. The second image receiving circuit 1150 uses a second buffer control signal 1152 to transmit at least a portion of image data based on the second display control signal 1112 to the second line buffer 1160.

The first line buffer 1140 and the second line buffer 1160 temporarily store, in memories, at least portions of image data of the first and second images A and B. The image data of the first and second images A and B is to be transmitted in a state in which the first image A is oriented in the direction in which the scan lines of the first image A extend and in which the second image B is oriented in the direction in which the scan lines of the second image B extend. Note that each of the first line buffer 1140 and the second line buffer 1160 may store, as a collection of data, data of multiple rows extending in an extension direction of scan lines, or may divide, into multiple data portions, data of a single row extending in an extension direction of scan lines and store the data portions, based on the size of the buffer or a postprocessing method.

The image transmitting circuit 1170 extracts, from the first and second line buffers 1140 and 1160, first transfer data 1141 including at least a portion of the image data of the first image A and second transfer data 1161 including at least a portion of the image data of the second image B based on the first transfer control signal 1131 and the second transfer control signal 1151, converts the extracted first and second transfer data 1141 and 1161 to an image transfer signal 1101, and outputs the image transfer signal 1101.

Even if the vertical and horizontal directions of the first image A with respect to the direction in which the scan lines of the first image A extend are different from the vertical and horizontal directions of the second image B with respect to the direction in which the scan lines of the second image B extend, the image transmitting circuit 1170 outputs the image transfer signal 1101 including the image data in a state in which the vertical and horizontal directions of the first image A are different from the vertical and horizontal directions of the second image B. In this manner, the image transferring device 1120 does not use a frame buffer but uses the first and second line buffers 1140 and 1160 to store and transfer the first and second images A and B in which the vertical and horizontal directions of the first image A with respect to the direction in which the scan lines of the first image A extend are different from the vertical and horizontal directions of the second image B with respect to the direction in which the scan lines of the second image B extend. Hence, the image transfer signal 1101 output by the processing device 1100 includes the image data of the images oriented in the different directions.

Configuration of Display Device 1200

The display device 1200 includes an image receiving device 1210 and an image display unit 1270.

The image receiving device 1210 includes an image receiver 1220, an image processing unit 1230, a display frame buffer 1250, and a display interface 1260.

The image receiver 1220 receives the image transfer signal 1101. The image receiver 1220 uses a reception signal 1221 to transfer the received image transfer signal 1101 to the image processing unit 1230. As described above, the image transfer signal 1101 includes the first and second images A and B in which the vertical and horizontal directions of the first image A with respect to the direction in which the scan lines of the first image A extend are different from the vertical and horizontal directions of the second image B with respect to the direction in which the scan lines of the second image B extend.

The image processing unit 1230 receives and analyzes the reception signal 1221 including information of the first and second images A and B. The reception signal 1221 includes identification information for identifying each of the two images of the received image data. The reception signal 1221 includes determination information for determining the vertical and horizontal directions of the two images of the received image data with respect to the directions in which the scan lines of the two images of the received image data extend. The image processing unit 1230 receives the reception signal 1221, references the identification included in the reception signal 1221, restores the images, and causes the restored images to be stored in corresponding regions of the display frame buffer 1250.

In addition, the image processing unit 1230 restores the images, writes the images to the display frame buffer 1250, references the determination information, and rotates at least one of the first and second images A and B. The orientation of the at least one of the first and second images A and B is appropriately corrected by the rotation, and the first and second images A and B are stored in the display frame buffer 1250.

The display frame buffer 1250 is secured in, for example, a DRAM included in a processor. The display frame buffer 1250 temporarily store, in a memory, at least a portion of the first and second images A and B in units of frames, each of which includes a single image. The display frame buffer 1250 is not limited to a buffer for storing each of frames of the first and second images A and B as a collection of data as a unit of processing. The display frame buffer 1250 may store multiple frames as a collection of data or may divide each of the frames into multiple frame portions and store the multiple frame portions of each of the frames.

The first and second images A and B written to the display frame buffer 1250 are transferred by a CPU or GPU within an SoC to the display interface 1260.

The display interface 1260 generates, based on details written to the display frame buffer 1250, a display control signal 1261 to control the image display unit 1270 and outputs the generated display control signal 1261. The display interface 1260 may output, to the image display unit 1270, the first and second images A and B based on the details written to the display frame buffer 1250 without changing the first and second images A and B, or may adjust the resolution and size of the screen or convert the first and second images A and B to windows and output the first and second images A and B. For example, the display interface 1260 may use a low voltage differential signaling (LVDS) output function, and include a liquid crystal display used as the image display unit 1270.

The image display unit 1270 updates the displayed images based on the display control signal 1261. The display device 1200 executes the aforementioned operations, thereby displaying, in the image display unit 1270, the images generated by the image generating device 1110 based on the received image transfer signal 1101.

Regarding Orientation of Images

Figure 2A:
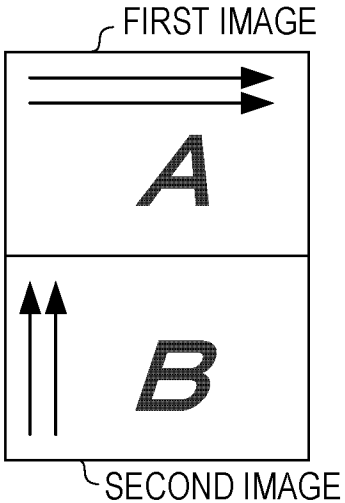
FIGS. 2A, 2B, and 2C are diagrams showing the orientation of a first image and the orientation of a second image.
Figure 2B:
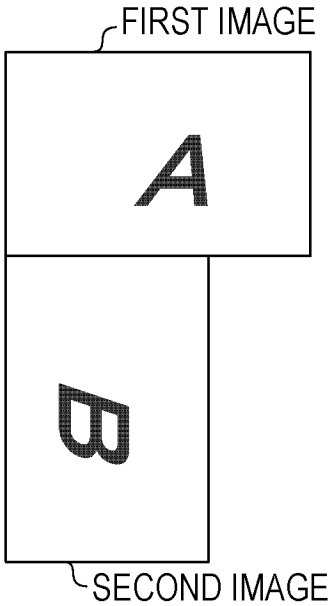
Figure 2C:
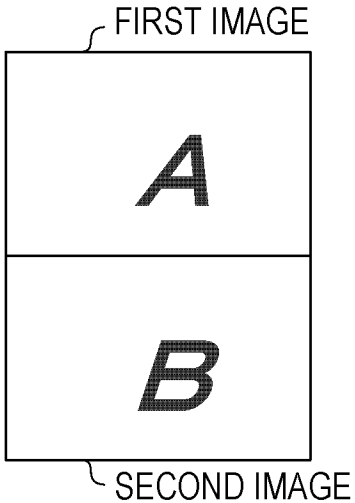

FIGS. 2A, 2B, and 2C are diagrams showing the orientation of the first image A and the orientation of the second image B. FIG. 2A is a diagram showing the orientations of the first and second images A and B generated by the image generating device 1110. In FIG. 2A, regions indicated by "A" and "B" indicate the first image A and the second image B, respectively. Arrows indicated in FIG. 2A indicate directions in which the scan lines of the images extend. In the first image A, data for display control is scanned from the left side of FIG. 2A to the right side of FIG. 2A. In the second image B, data for display control is scanned from the lower side of FIG. 2A to the upper side of FIG. 2A. Thus, data based on the first image A and stored in the first line buffer 1140 is image data in which the horizontal direction of the first image A is parallel to the direction in which the scan lines of the first image A extend. In addition, data based on the second image B and stored in the second line buffer 1160 is image data in which the vertical direction of the second image B is parallel to the direction in which the scan lines of the second image B extend. Specifically, the second image B is image data counterclockwise rotated by 90 degrees with respect to the first image A.

FIG. 2B shows the first and second images A and B transmitted using the image transfer signal 1101 output by the image transmitting circuit 1170. Since the first image A and the second image B are transferred using the image transfer signal 1101 in a state in which the direction in which the scan lines of the first image A extend is aligned with the direction in which the scan lines of the second image B extend, the first image A and the second image B are transferred in a state in which the second image B is clockwise rotated by 90 degrees with respect to the first image A, as shown in FIG. 2B.

After the first and second images A and B included in the image transfer signal 1101 are stored in the first and second line buffers 1140 and 1160 in a state in which the first and second images A and B are oriented in the directions in which the scan lines of the first and second images A and B extend, the first and second images A and B are converted by the image transmitting circuit 1170 to the image transfer signal 1101. Hence, the orientation of the first image A is different from the orientation of the second image B, differently from the original states of the first and second images A and B.

FIG. 2C shows the first and second images A and B displayed in the image display unit 1270. The image processing unit 1230 references the determination information and counterclockwise rotates the second image B loaded in the display frame buffer 1250 by 90 degrees with respect to the first image A. Thus, the first and second images A and B written to the display frame buffer 1250 are restored and displayed in the image display unit 1270 so that the original orientation of the first and second images A and B is realized, as shown in FIG. 2C. The image processing unit 1230 may execute a process of rotating at least one of the first and second images A and B in the loading of the first and second images A and B into the display frame buffer 1250.

Comparative Example

Figure 4:
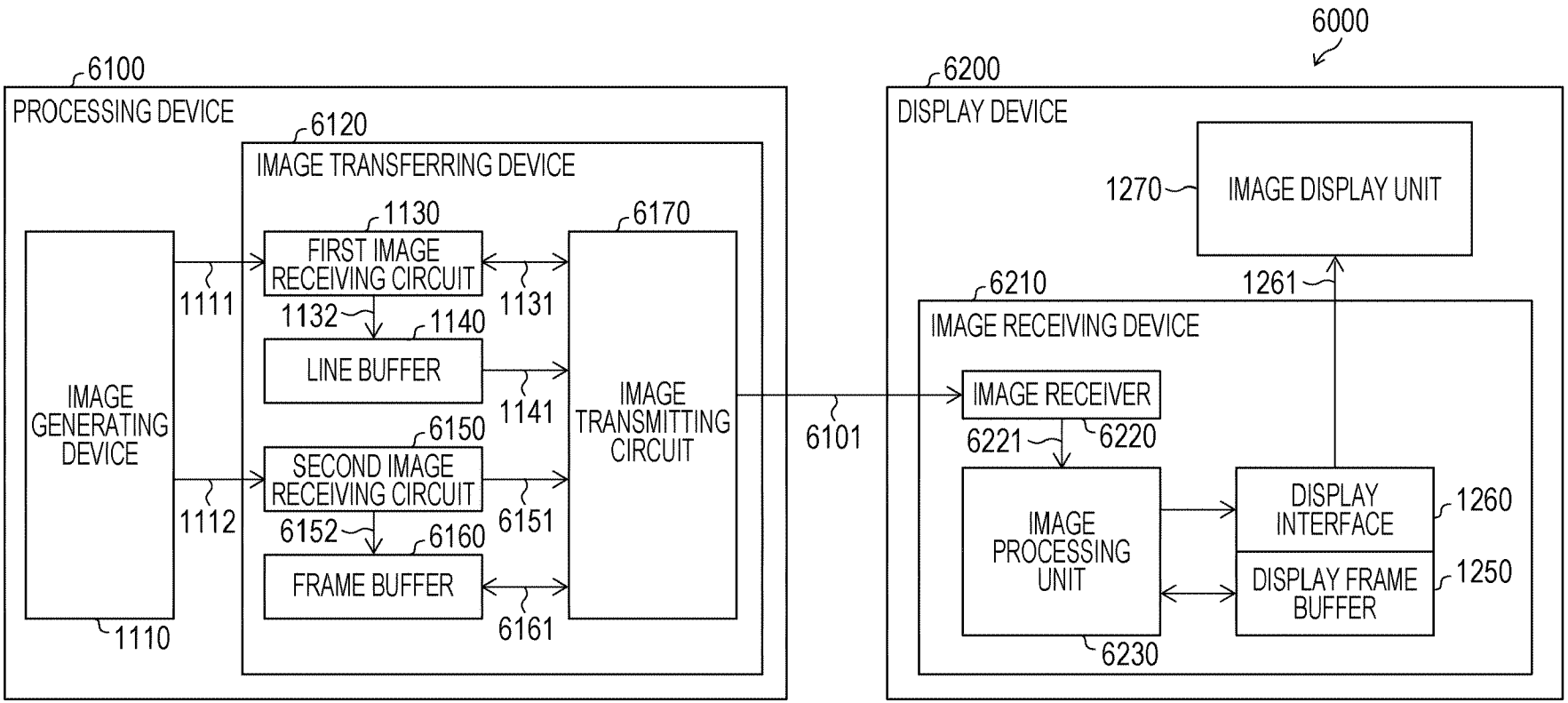
FIG. 4 is a block diagram showing a main configuration of an image processing system according to a comparative example.

FIG. 4 is a diagram showing a main configuration of an image processing system 6000 according to a comparative example. As shown in FIG. 4, an image transferring device 6120 of the image processing system 6000 includes a frame buffer 6160 for storing at least a portion of the image data based on the second display control signal 1112.

A second image receiving circuit 6150 of the image transferring device 6120 uses a second buffer control signal 6152 to cause at least a portion of the image data based on the second display control signal 1112 to be stored in a frame buffer 6160. In the frame buffer 6160, the second image B counterclockwise rotated by 90 degrees with respect to the first image A is stored.

An image transmitting circuit 6170 causes the orientation of the second image B stored in the frame buffer 6160 to match the orientation of the first image A and uses an image transfer signal 6101 to transmit the first image A and the second image B to an image receiving device 6210.

In this manner, the image transferring device 6120 uses the frame buffer 6160 to set the first and second images A and B in which the vertical and horizontal directions of the first image A with respect to the direction in which the scan lines of the first image A extend were previously different from the vertical and horizontal directions of the second image B with respect to the direction in which the scan lines of the second image B extend so that the vertical and horizontal directions of the first image A are the same as the vertical and horizontal directions of the second image B. Then, the image transferring device 6120 outputs the first image A and the second image B. The frame buffer 6160 uses a larger memory capacity than a line buffer, resulting in a significant increase in the cost and an increase in power consumption, compared with an image transferring device realized by only line buffers.

When the frame buffer 6160 is used in the image transferring device 6120, image transfer is not started until the frame buffer 6160 becomes full of image data. Thus, the delay from the time when images are generated to the time when the images are finally displayed is longer, compared with the case where line buffers are used.

In the first embodiment, the image receiving device 1210 of the display device 1200 includes the image processing unit 1230 that rotates at least one of the received first and second images A and B. Thus, multiple images in which vertical and horizontal directions of one of the images with respect to a direction in which scan lines of the one of the images extend are different from vertical and horizontal directions of the other of the images with respect to a direction in which scan lines of the other of the images extend may be displayed without using a frame buffer. In addition, the processing device 1100 does not include a frame buffer and uses only the line buffers to output the first and second images A and B in which the vertical and horizontal directions of the first image A with respect to the direction in which the scan lines of the first image A extend are different from the vertical and horizontal directions of the second image B with respect to the direction in which the scan lines of the second image B extend. It is therefore possible to suppress an increase in the capacities of the memories, reduce the cost and power consumption, and suppress an increase in the delay from the time when images are generated to the time when the images are displayed.

Second Embodiment

A second embodiment is described below with reference to FIG. 3. Members that have the same functions as the members described in the first embodiment are indicated by the same reference symbols as those described in the first embodiment, and a description thereof is not repeated.

Figure 3:
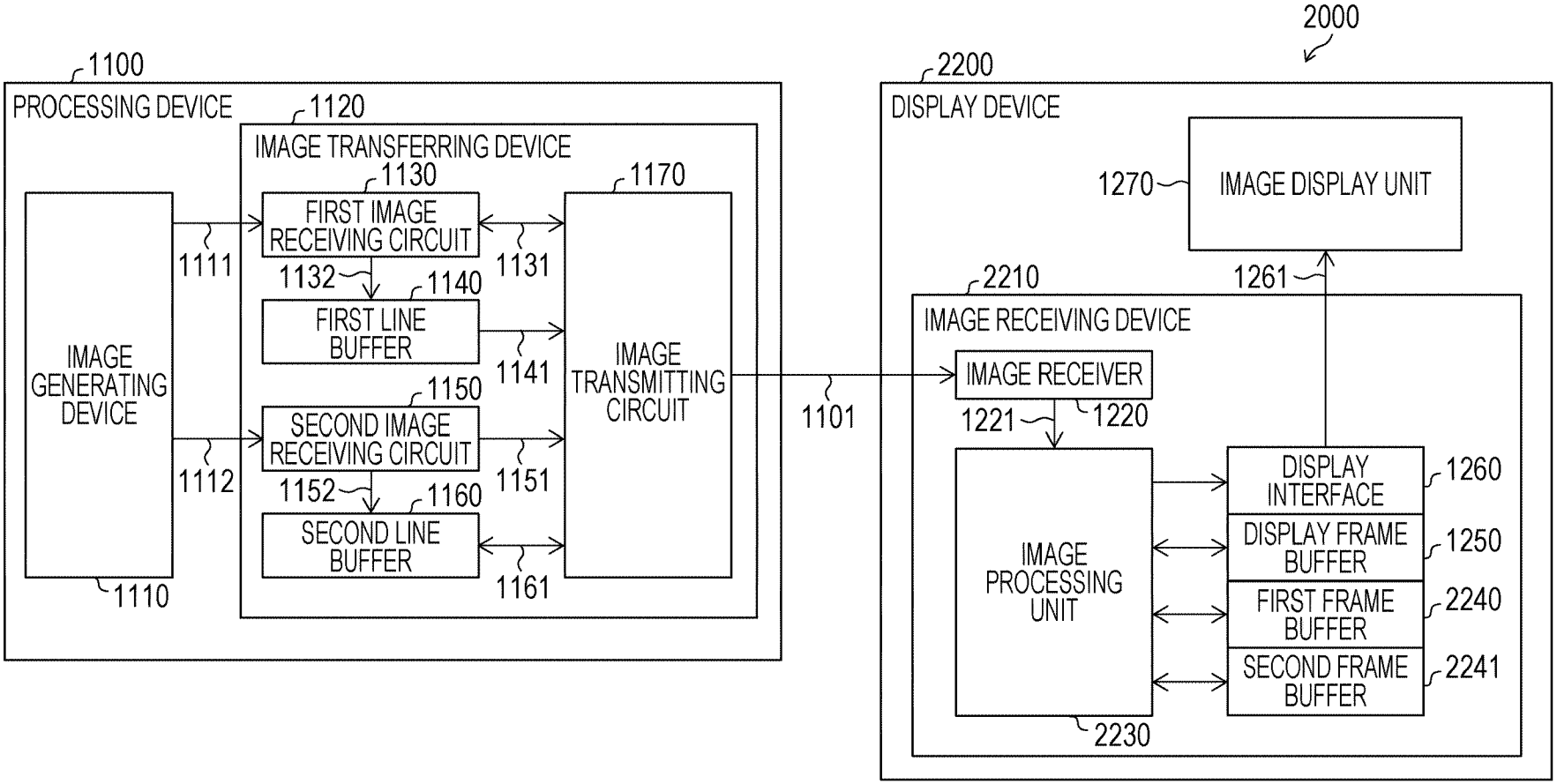
FIG. 3 is a block diagram showing a main configuration of an image processing system according to a second embodiment.

FIG. 3 is a block diagram showing a main configuration of an image processing system 2000 according to the second embodiment. As shown in FIG. 3, the image processing system 2000 includes a processing device 1100 and a display device 2200. The image processing system 2000 displays, in the display device 2200, multiple images generated by the processing device 1100. The image processing system 2000 is different from the first embodiment in a configuration of the display device 2200. The configuration of the processing device 1100 is the same as that described in the first embodiment, and a description thereof is omitted.

The display device 2200 includes an image receiving device 2210 and an image display unit 1270. The image receiving device 2210 includes an image receiver 1220, an image processing unit 2230, a display frame buffer 1250, a display interface 1260, a first frame buffer 2240, and a second frame buffer 2241.

The image processing unit 2230 acquires image data from the image receiver 1220. A reception signal 1221 includes identification information identifying each of the two images and image data of the two images in which the orientation of one of the two images with respect to a direction in which scan lines of the one of the images extend is different from the orientation of the other of the images with respect to a direction in which scan lines of the other of the images extend. The image processing unit 1230 references the identification information, restores the images, loads the restored two images separately into the first and second frame buffers 2240 and 2241 so that the images are oriented in the directions in which the scan lines of the images extend. For example, the first frame buffer 2240 and the second frame buffer 2241 may be secured in a DRAM (not shown) included in the display device 2200. The first image A and the second image B are treated as independent image data by the aforementioned processes.

The image data loaded in the first and second frame buffers 2240 and 2241 is combined to form a final display image in the writing of the image data to the display frame buffer 1250. In the combining process, the image processing unit 2230 may process the image data to form a display image including either one of the first and second images A and B. Alternatively, the image processing unit 2230 may process the image data to form a display image in which the first image A and the second image B are to be displayed side by side. Alternatively, the image processing unit 2230 may process the image data so that at least a portion of display details of one of the first and second images A and B is included in at least a portion of display details of the other of the first and second images A and B.

In addition, the image processing unit 2230 references the determination information and rotates at least one of the first and second images A and B loaded in the first and second frame buffers 2240 and 2241. Note that the image processing unit 2230 may execute a process of rotating at least one of the first and second images A and B in the writing of the first and second images A and B to the first and second frame buffers 2240 and 2241. Alternatively, the image processing unit 2230 may rotate at least one of the first and second images A and B in the combining process of writing the first and second images A and B loaded in the first and second frame buffers 2240 and 2241 to the display frame buffer 1250.

The rotation of at least any of the images may be enabled by a GPU included in an SoC. Since the GPU may execute the rotation process instead of a CPU, a load (calculation of indices upon the writing to the frame buffers) that may be applied to the CPU due to the rotation process may be reduced.

According to these configurations, degrees of freedom of the processes to be executed to display the received multiple images may be improved and processes to be executed by the CPU may be reduced.

Additional Matters

The first and second embodiments describe the case where the two images are transferred, but the embodiments are not limited to this. The first and second embodiments are applicable to the case where three images or more are transferred in a state in which vertical and horizontal directions of at least one of the images with respect to a direction in which scan lines of the image extend are different from vertical and horizontal directions of the other images with respect to directions in which scan lines of the other images extend.

Since multiple images are transferred from the processing device to the display device via a transfer interface of one system, a transfer protocol may be based on a packet scheme and the images may be transferred using packets different for the images. In this case, the transfer protocol that is usable for general purposes for transfer of multiple images in various configurations may be realized by causing the packets to include identification information such as IDs identifying the images to be transmitted using the packets and determination information indicating vertical and horizontal directions of the images with respect to directions in which scan lines of the images extend. In addition, if each of the images is divided into multiple packets and transmitted, it is desirable that the packets include information of positions in the images to be transmitted using the packets so that even if one of the packets is lost, the other packets are used.

Example of Realization by Software

The processing device 1100 and the control blocks (especially, the image transferring device 1120 and the image receiving devices 1210 and 2210) of the display devices 1200 and 2200 may be realized by logical circuits (hardware) formed in integrated circuits (IC chips) or the like or may be realized by software.

In the latter case, the processing device 1100 and the display devices 1200 and 2200 include computers that execute commands of programs, which are software for enabling the functions of the devices. Each of the computers includes at least one processor (control device) and at least one computer-readable storage medium storing a respective one of the programs. In the computers, the processors read the programs from the storage media and execute the read programs to realize the aforementioned transfer and display of the images. As the processors, central processing units (CPUs) may be used, for example. As the storage media, "non-transitory tangible media", for example, read only memories (ROMs), tapes, disks, cards, semiconductor memories, programmable logical circuits, or the like may be used. In addition, the computers may include random access memories (RAMs) in which the programs are loaded. Furthermore, the programs may be supplied to the computers via an arbitrary transmission medium (communication network, broadcast wave, or the like) that enables the programs to be transmitted. The techniques disclosed herein may be realized using a data signal included in a carrier wave and realized by electronic transmission of the programs.

CONCLUSION

According to a first aspect of the disclosure, each of the image display systems 1000 and 2000 includes the image generating device 1110 for generating and outputting multiple images, the image transferring device 1120 for converting the multiple images to an image transfer signal 1101 and outputting the image transfer signal 1101, the image receiving device 1210 or 2210 for receiving the image transfer signal 1101 and restoring the multiple images, and the image display unit 1270 for displaying the multiple images restored by the image receiving device 1210 or 2210. The image receiving device 1210 or 2210 includes the image processing unit 1230 or 2230 that rotates at least one of first and second images A and B if the received image transfer signal 1101 includes the first and second images A and B in which a direction in which a scan line of the first image A extends is different from a direction in which a scan line of the second image B extends.

According to the aforementioned configuration, since the image receiving device 1210 or 2210 rotates at least one of the first and second images A and B in which the vertical and horizontal directions of the first image A with respect to the direction in which the scan line of the first image A extends are different from the vertical and horizontal directions of the second image B with respect to the direction in which the scan line of the second image B extends, the image transferring device 1120 does not include a frame buffer. It is therefore possible to suppress an increase in the capacities of the memories of the image transfer device 1120, reduce the cost and power consumption, and suppress the occurrence of a delay in the transfer of images. Thus, multiple images in which vertical and horizontal directions of one of the images with respect to a direction in which a scan line of the one of the images extends are different from vertical and horizontal directions of the other of the images with respect to a direction in which a scan line of the other of the images extends may be efficiently displayed.

According to a second aspect of the disclosure, in the first aspect, in the image display systems 1000 and 2000, the image transferring device 1120 may include the first line buffer 1140 for storing at least a portion of image data indicating the first image A and arranged in the direction in which the scan line of the first image A extends, the second line buffer 1160 for storing at least a portion of image data indicating the second image B and arranged in the direction in which the scan line of the second image B extends, and the image transmitting circuit 1170 for transmitting, to the image receiving device 1210 or 2210, the image data pieces for transfer stored in the first and second line buffers 1140 and 1160.

According to the aforementioned configuration, the image transferring device 1120 does not use a frame buffer and uses the first and second line buffers 1140 and 1160 to output the first and second images A and B in which the vertical and horizontal directions of the first image A with respect to the direction in which the scan line of the image A extends are different from the vertical and horizontal directions of the second image B with respect to the direction in which the scan line of the image B extends. It is therefore possible to suppress an increase in the capacities of the memories of the image transferring device 1120, reduce the cost and power consumption, and suppress the occurrence of a delay in the transfer of images. Thus, multiple images in which vertical and horizontal directions of one of the images with respect to a direction in which a scan line of the one of the images extends are different from vertical and horizontal directions of the other of the images with respect to a direction in which a scan line of the other of the images extends may be efficiently displayed.

According to a third aspect of the disclosure, in the first or second aspect, in each of the image display systems 1000 and 2000, the image receiving device 1210 or 2210 may include the display frame buffer 1250 for storing the restored first and second images A and B, and write the first and second images A and B to the display frame buffer 1250 so that the first and second images A and B are oriented in the directions in which the scan lines of the first and second images A and B extend.

According to the aforementioned configuration, the first image A and the second image B are loaded into the display frame buffer 1250 of the image receiving device 1210 or 2210. Thus, the first and second images A and B in which the vertical and horizontal directions of the first image A with respect to the direction in which the scan line of the first image A extends are different from the vertical and horizontal directions of the second image B with respect to the direction in which the scan line of the second image B extends are restored and stored in the display frame buffer 1250. Thus, multiple images may be efficiently displayed.

According to a fourth aspect of the disclosure, in the first or second aspect, in the image display system 2000, the image receiving device 2210 may include the first frame buffer 2240 for storing the restored first image A, and the second frame buffer 2241 for storing the restored second image B, and the image display unit 1270 may display a single image formed by combining the first image A with the second image B.

According to the aforementioned configuration, the image receiving device 2210 may store the restored first and second images A and B in the first and second frame buffers 2240 and 2241 to suppress the occurrence of a delay in the display of the images.

According to a fifth aspect of the disclosure, in the first aspect, in each of the image display systems 1000 and 2000, a protocol of data to be transmitted using the image transfer signal 1101 may include identification information identifying, among the multiple images, an image corresponding to the data, and determination information for determining a direction in which a scan line of the image extends.

According to the aforementioned configuration, identification information identifying the first and second images A and B and determination information for determining the directions in which the scan lines of the images extend may be referenced, and the image receiving device 1210 or 2210 may restore the images and combine the images with each other. Thus, the image transferring device 1120 may not include a frame buffer, and multiple images in which vertical and horizontal directions of one of the images with respect to a direction in which a scan line of the one of the images extends are different from vertical and horizontal directions of the other of the images with respect to a direction in which a scan line of the other of the images extends may be efficiently displayed.

According to each of the aspects of the disclosure, each of the processing device 1100 and the display devices 1200 and 2200 may be realized by a computer. In this case, a control program for controlling the processing device 1100 and the display devices 1200 and 2200 realized by causing the computers to operate as the functions (software elements) of the processing device 1100 and the display devices 1200 and 2200, and a computer-readable storage medium storing the control program fall within the scope of the disclosure.

The techniques disclosed herein are not limited to the embodiments and may be variously changed within the scope of the appended claims. An embodiment obtained by combining technical elements disclosed in the different embodiments is included in the technical scope of the disclosure. In addition, a new technical characteristic may be obtained by combining technical elements disclosed in the embodiments.

The present disclosure contains subject matter related to that disclosed in Japanese Priority Patent Application JP 2017-198606 filed in the Japan Patent Office on Oct. 12, 2017, the entire contents of which are hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. An image display system comprising:

an image generating circuit that generates and outputs multiple images;

an image transferring circuit that converts the multiple images to an image transfer signal and outputs the image transfer signal;

an image receiving circuit that receives the image transfer signal and restores the multiple images; and an image display unit that displays the multiple images restored by the image receiving circuit, wherein the image receiving circuit includes an image processing circuit that rotates at least one of first and second images if the received image transfer signal includes the first and second images in which a direction in which a scan line of the first image extends is different from a direction in which a scan line of the second image extends, and the image transferring circuit includes a first line buffer that stores at least a portion of image data indicating the first image and arranged in the direction in which the scan line of the first image extends, a second line buffer that stores at least a portion of image data indicating the second image and arranged in the direction in which the scan line of the second image extends, and an image transmitting circuit that transmits, to the image receiving circuit, the image data pieces for transfer stored in the first and second line buffers.

2. The image display system according to claim 1, wherein the image receiving circuit includes a frame buffer that stores the restored first image and the restored second image, and the image receiving circuit writes the first image and the second image to the frame buffer so that the first image is oriented in the direction in which the scan line of the first image extends and that the second image is oriented in the direction in which the scan line of the second image extends.

3. The image display system according to claim 1, wherein the image receiving circuit includes a first frame buffer that stores the restored first image, and a second frame buffer that stores the restored second image, and the image display unit displays a single image formed by combining the first image with the second image.

4. The image display system according to claim 1, wherein a protocol of data to be transmitted using the image transfer signal includes identification information identifying, among the multiple images, an image corresponding to the data, and determination information for determining a direction in which a scan line of the image extends.

5. An image display system comprising:

an image generating circuit that generates and outputs multiple images including first and second images in which a direction in which a scan line of the first image extends is different from a direction in which a scan line of the second image extends;

an image transferring circuit that converts the multiple images to an image transfer signal including the first and second images in which the direction in which the scan line of the first image extends is different from the direction in which the scan line of the second image extends, and outputs the image transfer signal;

an image receiving circuit that receives the image transfer signal and restores the multiple images; and an image display unit that displays the multiple images restored by the image receiving circuit, wherein the image receiving circuit includes an image processing circuit that rotates at least one of the first and second images if the received image transfer signal includes the first and second images in which the direction in which the scan line of the first image extends is different from the direction in which the scan line of the second image extends.

6. The image display system according to claim 5, wherein the image transferring circuit includes a first line buffer that stores at least a portion of image data indicating the first image and arranged in the direction in which the scan line of the first image extends, a second line buffer that stores at least a portion of image data indicating the second image and arranged in the direction in which the scan line of the second image extends, and an image transmitting circuit that transmits, to the image receiving circuit, the image data pieces for transfer stored in the first and second line buffers.

7. The image display system according to claim 5, wherein the image receiving circuit includes a frame buffer that stores the restored first image and the restored second image, and the image receiving circuit writes the first image and the second image to the frame buffer so that the first image is oriented in the direction in which the scan line of the first image extends and that the second image is oriented in the direction in which the scan line of the second image extends.

8. The image display system according to claim 5, wherein the image receiving circuit includes a first frame buffer that stores the restored first image, and a second frame buffer that stores the restored second image, and the image display unit displays a single image formed by combining the first image with the second image.

9. The image display system according to claim 5, wherein a protocol of data to be transmitted using the image transfer signal includes identification information identifying, among the multiple images, an image corresponding to the data, and determination information for determining a direction in which a scan line of the image extends.

* * * * *